United States Patent [19]

Boggs et al.

[11] 4,410,026

[45] Oct. 18, 1983

[54] PORT BLOCK ASSEMBLY FOR INTERCONNECTING A FLUID CONTAINER WITH A FLUID CONDUIT

[75] Inventors: Daniel R. Boggs, Vernon Hills; Carl Aronson, Wauconda, both of Ill.

[73] Assignee: Baxter Travenol Laboratories, Inc., Deerfield, Ill.

[21] Appl. No.: 282,894

[22] Filed: Jul. 13, 1981

[51] Int. Cl.[3] ..... B65D 30/24

[52] U.S. Cl. ..... 383/60; 383/55; 604/244; 604/262; 604/408; 137/68 R

[58] Field of Search ..... 137/68 R; 150/0.5.9.8; 229/55, 62.5; 222/107; 128/DIG. 24; 604/244, 262, 408, 409, 410; 285/137 R, 332, 21

[56] References Cited

U.S. PATENT DOCUMENTS

| | | | |
|---|---|---|---|
| 2,877,028 | 3/1959 | Knight | 285/137 R |
| 3,205,889 | 9/1965 | Alder | 150/0.5 X |
| 3,248,040 | 4/1966 | Friedman | 229/55 |
| 3,295,725 | 1/1967 | Brandt | 150/0.5 X |
| 3,635,091 | 1/1972 | Linzer . | |
| 3,700,018 | 10/1972 | Goglio | 150/0.5 |
| 3,842,389 | 10/1974 | Glover | 285/137 R X |
| 4,161,179 | 7/1979 | Abramson | 128/DIG. 24 UX |
| 4,294,247 | 10/1981 | Carter | 150/8 |
| 4,327,726 | 5/1982 | Kwong | 150/8 X |

*Primary Examiner*—Harold W. Weakley

*Attorney, Agent, or Firm*—Paul C. Flattery; Daniel D. Ryan

[57] ABSTRACT

A port block assembly for interconnecting a fluid container with a fluid conduit includes a body which has a port and which is attachable to the container with the port in flow communication with the container interior. The assembly also includes a rigid, tubular insert which is engageable within the body port and to which the fluid conduit can be attached. A secure and rugged interconnection between the container and the conduit results. When the container and conduit are fabricated from dissimilar materials, the body of the assembly is fabricated from the same materal as the container, and the associated insert is fabricated from the same material as the conduit and adapted for an interference or friction fit within the body port. The same secure and rugged interconnection between the container and conduit is achieved, despite the presence of dissimilar materials.

19 Claims, 5 Drawing Figures

PORT BLOCK ASSEMBLY FOR INTERCONNECTING A FLUID CONTAINER WITH A FLUID CONDUIT

FIELD OF THE INVENTION

The invention generally relates to fluid containers, particularly those suited for the storage and dispensing of parenteral solutions and the like. The invention also relates to the attachment of these containers to associated fluid conduits.

The invention also generally relates to fluid containers fabricated from materials having low water vapor loss characteristics, as well as the attachment of these containers to conduits fabricated from dissimilar materials.

DESCRIPTION OF THE PRIOR ART

It is desirable to connect a fluid container to a fluid circuit in a secure and durable manner. This type of connection is particularly desirable when sterile parenteral fluids are involved.

It is also desirable to protect solutions stored in containers from the diffusion of water vapor through the container walls, because this can in time lead to a change in the concentration of the stored solution. Protection against water vapor loss is particularly desirable when the stored fluid is a sterile parenteral solution.

Formulations of polyvinyl chloride plastic are widely used for parenteral solution containers and the like. However, because polyvinyl chloride plastic has a relatively high water vapor loss characteristic, various substitute plastic formulations have been proposed. In this regard, attention is directed to the following U.S. Patents:

Sako et al.—U.S. Pat. No. 3,940,802—Mar. 2, 1976
Grode et al.—U.S. Pat. No. 4,112,989—Sept. 12, 1978
Waage—U.S. Pat. No. 3,942,529—Mar. 9, 1976
Rinfret—U.S. Pat. No. 4,131,200—Dec. 26, 1978
Watt—U.S. Pat. No. 4,183,434—Jan. 15, 1980
Gajewski et al.—U.S. Pat. No. 4,210,686—July 1, 1980
Smith—U.S. Pat. No. 4,222,379—Sept. 16, 1980

Many of the proposed substitutes for polyvinyl chloride plastic, while having lower water vapor loss characteristics, are chemically dissimilar to polyvinyl chloride plastic and, as a result, do not readily and securely bond to polyvinyl chloride plastic tubing by conventional thermal or chemical means. The following pending U.S. Applications, which are assigned to the assignee of the present invention, generally address the problem of interconnecting polyvinyl chloride plastic tubing with fluid containers of dissimilar materials:

U.S. application Ser. No. 041,838, filed May 23, 1979, and entitled "TUBING CONNECTION FOR CONCONTAINERS GENERALLY UTILIZING DISSIMILAR MATERIAL".

U.S. application Ser. No. 067,068, filed Aug. 15, 1979, and entitled "CONNECTOR MEMBER FOR DISSIMILAR MATERIALS".

With the above considerations in mind, it is one of the principal objects of this invention to provide an assembly which serves to interconnect a fluid container with a fluid conduit in a secure and durable manner, and which facilitates the permanent, integral connection of the container with a prearranged fluid circuit, such as that disclosed in pending U.S. application Ser. No. 100,975, filed Dec. 6, 1979 and entitled "MONITOR AND FLUID CIRCUIT ASSEMBLY" (assigned to the assignee of the present invention).

It is another principal object of this invention to provide an assembly which facilitates the secure and durable interconnection of a container with a conduit, even though dissimilar materials are utilized.

It is still another principal object of this invention to provide an assembly which facilitates the construction of a container having a low water vapor loss characteristic, as well as the interconnection of this container with a fluid conduit fabricated of a polyvinyl chloride plastic material.

SUMMARY OF THE INVENTION

To achieve these and other objects, the invention provides a port block assembly for interconnecting a fluid container with a fluid circuit. The assembly includes a body portion which has a port and which is operative for attachment to the container with the port in flow communication with the interior of the container. The assembly also includes an insert portion which is engagable within the port of the body portion and which is attachable to a fluid conduit. A secure and durable connection between the container and conduit results.

In one embodiment, the insert portion includes, as an attachment thereto, a valve mechanism which normally blocks flow communication through the insert portion. The valve mechanism is manually operative for selectively opening the flow communication.

In one embodiment, the fluid container is fabricated of a material which has a relatively low water vapor transmission characteristic and which is not bondable to the polyvinyl chloride plastic material from which the fluid conduit is formed. In this embodiment, the body portion of the port block assembly is fabricated from the same material as the container and is thus directly bondable thereto. On the other hand, the insert portion is fabricated from polyvinyl chloride plastic for direct attachment to the fluid conduit and is adapted for interference fit engagement within the body portion port. The difficulty of effecting a thermal or chemical bond between the two dissimilar materials of the body and insert portions is thus overcome, and a secure, durable interconnection between the dissimilar container and conduit is achieved.

The invention also provides a solution container which utilizes the port block assembly as generally described above. In the preferred embodiment, the container includes first wall means, which peripherally encloses a fluid chamber, and second wall means, which is disposed outwardly of the first wall means and peripherally defines an interior area which envelops the fluid chamber. The second wall means includes an opening providing access into this interior area. In this embodiment, the body portion of the port block assembly is engaged in the access opening of the second wall means, and the insert portion is located within the body portion port in flow communication with the enveloped fluid chamber of the first wall means.

In this embodiment, the first wall means of the container and the insert portion of the port block assembly are both preferably fabricated from a polyvinyl chloride plastic material, as is the intended fluid conduit. The second wall means of the container is preferably fabricated from a material having a low permeability to water vapor and prevents the loss of water vapor from the interior fluid chamber into the atmosphere. In accordance with the invention, the body portion of the assembly is fabricated from the same material as the second wall means, and the polyvinyl chloride plastic insert portion is engaged in an interference fit within the body portion port to afford the desired interconnection between the container and the polyvinyl chloride plastic conduit.

The invention also provides a fluid circuit which includes conduit means defining a predetermined fluid flow path. The circuit also includes a container having an interior fluid chamber and an access opening thereto. The circuit utilizes the port block assembly as heretofore described to permanently and integrally interconnect the container with the conduit means to afford communication between the fluid chamber and the fluid flow path. The conduit means and the preattached containers form a fluid circuit which is substantially closed to the atmosphere.

Other features and advantages of the embodiments of the invention will become apparent upon reviewing the following more detailed description, the drawings, and the appended claims.

Before explaining the embodiments of the invention in detail, it is to be understood that the invention is not limited to its application to the details of construction and the arrangement of components as set forth in the following description or as illustrated in the accompanying drawings. The invention is capable of other embodiments and of being practiced or carried out in various ways. Furthermore, it is to be understood that the phraseology and terminology employed herein is for the purpose of description and should not be regarded as limiting.

DESCRIPTION OF THE PREFERRED EMBODIMENT

Figure 1:
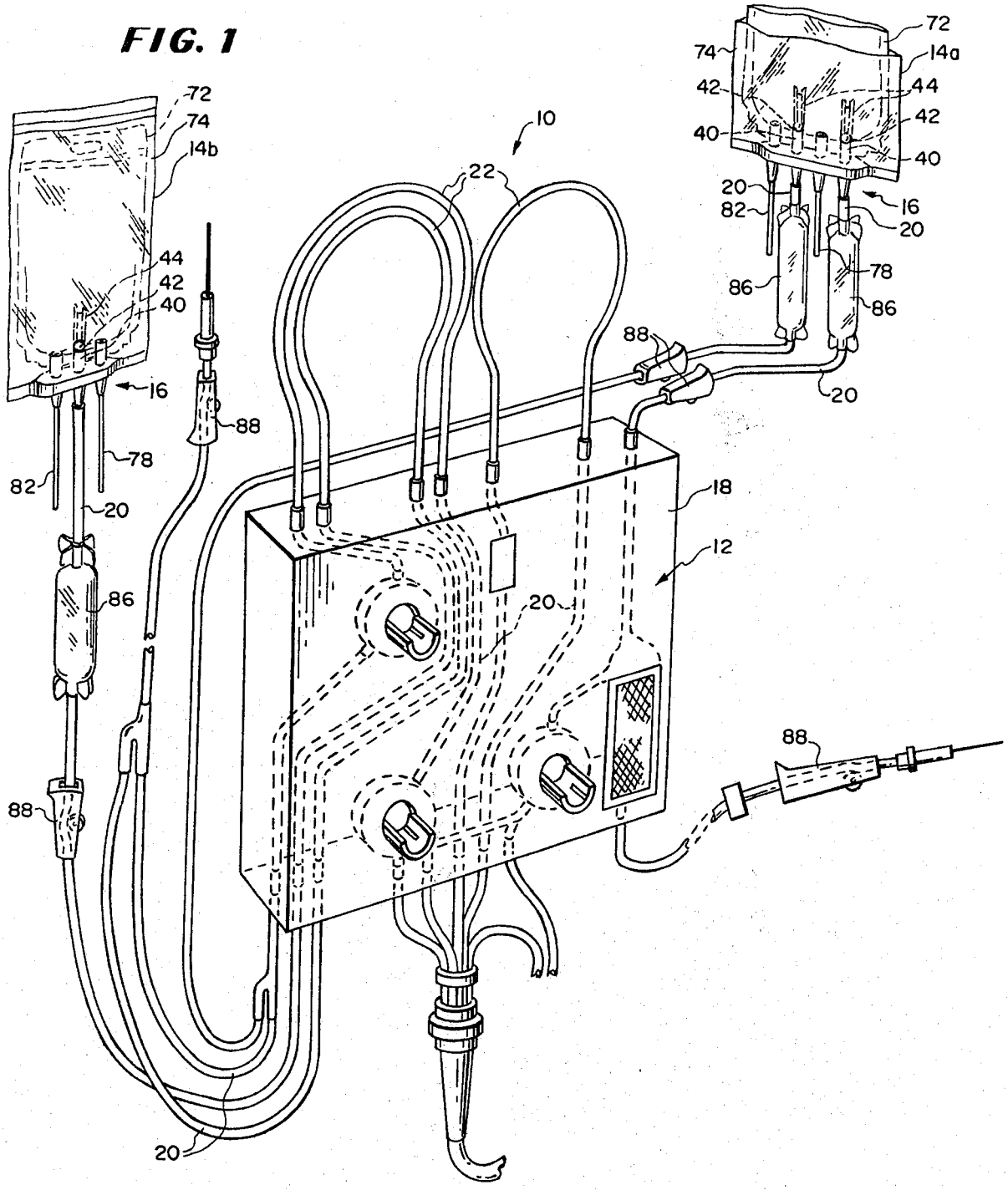
FIG. 1 is a perspective view, with parts broken away, of a portion of a fluid circuit which includes a pair of "double wrapped" fluid-filled containers, each of which is integrally connected to the circuit by the use of a port block assembly embodying various of the features of the invention.

A fluid circuit 10 is shown in FIG. 1. The circuit 10 includes conduit means 12 which defines a prearranged array of fluid flow paths. Such a circuit 10 is particularly well suited for use in environments in which relatively complex or convoluted fluid circuits are involved, and/or in which it is necessary or desirable to protect the interiors of the fluid flow paths from exposure to the atmosphere. For example, the circuit 10 is ideally suited for use in the collection and processing of human blood. The discussion to follow specifically contemplates such use, but the adaptability of the circuit 10 for use in other environments should be appreciated.

In the context of human blood collection and processing, the fluid circuit 10 includes a compact, portable module 18, or housing, in which one or more flexible tubes 20 extends. The tubes 20 define an array of paths through which the blood and blood components flow during the processing operation. In the particular embodiment illustrated in FIG. 1, the module 18 is configured to facilitate its mounting on a blood centrifugation device (not shown). Furthermore, portions 22 of the tubes are looped outwardly of the module 12 for operative engagement with peristaltic pump rotors (not shown) carried on the centrifugation device to pump blood and blood components through the tubes 20. A more detailed description of the module 12, its mounting, and the flow of fluids therethrough can be found in now pending U.S. application Ser. No. 100,975, heretofore cited.

A pair of fluid-filled containers, designated 14*a* and *b* in FIG. 1, are each individually attached to the conduit means 12 by use of a port block assembly 16 which embodies various of the features of the invention. The fluid-filled containers 14*a* and *b* thereby form an integral, or preattached, part of the fluid circuit 10.

In the environment of human blood collection and processing, one of the integrally attached containers (designated in FIG. 1 as 14*a*) preferably holds a sterile saline solution. The other one of the integrally attached containers (designated in FIG. 1 as 14*b*) preferably holds a sterile anticoagulant solution. These sterile solutions are introduced into the fluid paths during the blood processing procedure.

As before mentioned, the port block assembly 16 interconnects each container 14*a* and *b* with the fluid circuit 10. As can be best seen in FIGS. 2 through 4, the port block assembly 16 generally includes a body portion 24 in which one or more ports 26 are formed.

The assembly 16 also includes a separate, generally rigid insert portion 28 for each port 26. Each insert portion 28 includes a bore 30 and is fitted within its associated port 26. The bore 30 thus forms a fluid flow path. Each bore 30 includes an end 32 and an end 34 which extends outwardly beyond the body portion 24 for connection with an end of tubing 20.

Figure 2:
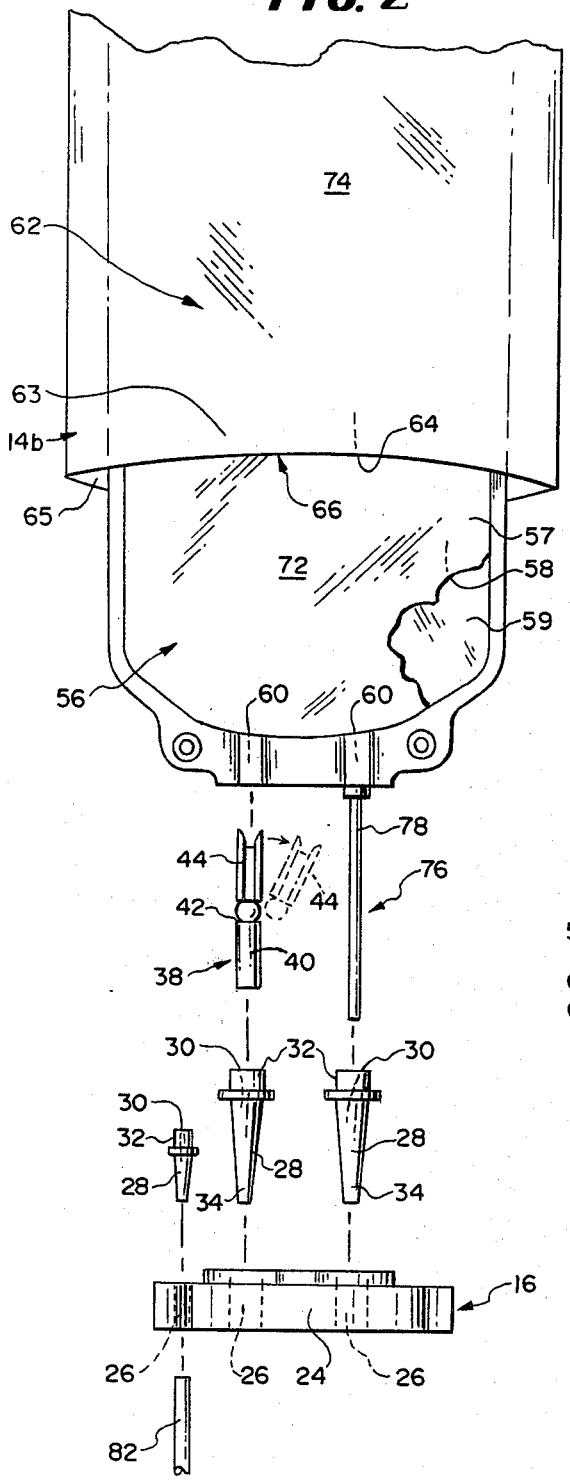
FIG. 2 is an enlarged and exploded view, with parts broken away, of one of the "double wrapped" containers and associated port block assembly shown in FIG. 1.

The number of ports 26 and associated inserts 28 can be preselected according to the number of fluid connections required. Furthermore, as is shown in FIG. 2, the assembly 16 includes valve means 38 which may be attached to the end 32 of a selected insert portion or portions 28, as desired. The valve means 28 normally blocks flow communication through the bore 30 of the selected insert portion 28 and is operative in response to manual manipulation for opening the flow communication through the selected insert portion 28.

The valve means 38 itself may be variously constructed. However, in the illustrated embodiment (see FIG. 2), the valve means 38 includes a generally rigid tubular member or cannula 40 which is attached, such as by solvent bonding, to the inner end 32 of the selected insert portion 28. The cannula 40 includes a frangible end wall 42 disposed therein, which normally blocks flow communication through the cannula 40 and, thus, through the selected insert portion 28 itself. In this arrangement, the valve means 38 includes means in the form of a rigid member 44 which extends outwardly from the frangible wall 42. Manual manipulation (generally shown by an arrow in FIG. 2) serves to break the rigid member 44 away and fracture the frangible wall 42 (as shown in phantom lines in FIG. 2). This operation opens flow communication through the cannula 40 and attached insert portion 28.

The port block assembly 16 lends itself to use with various types of fluid containers. Two embodiments are shown in the drawings, both of which are equally well suited for interconnection with the circuit 10. Containers 14*a* and *b* shown in FIGS. 1 through 3 each incorporates one such embodiment, and the container 46 shown in FIG. 5 incorporates the other.

Figure 5:
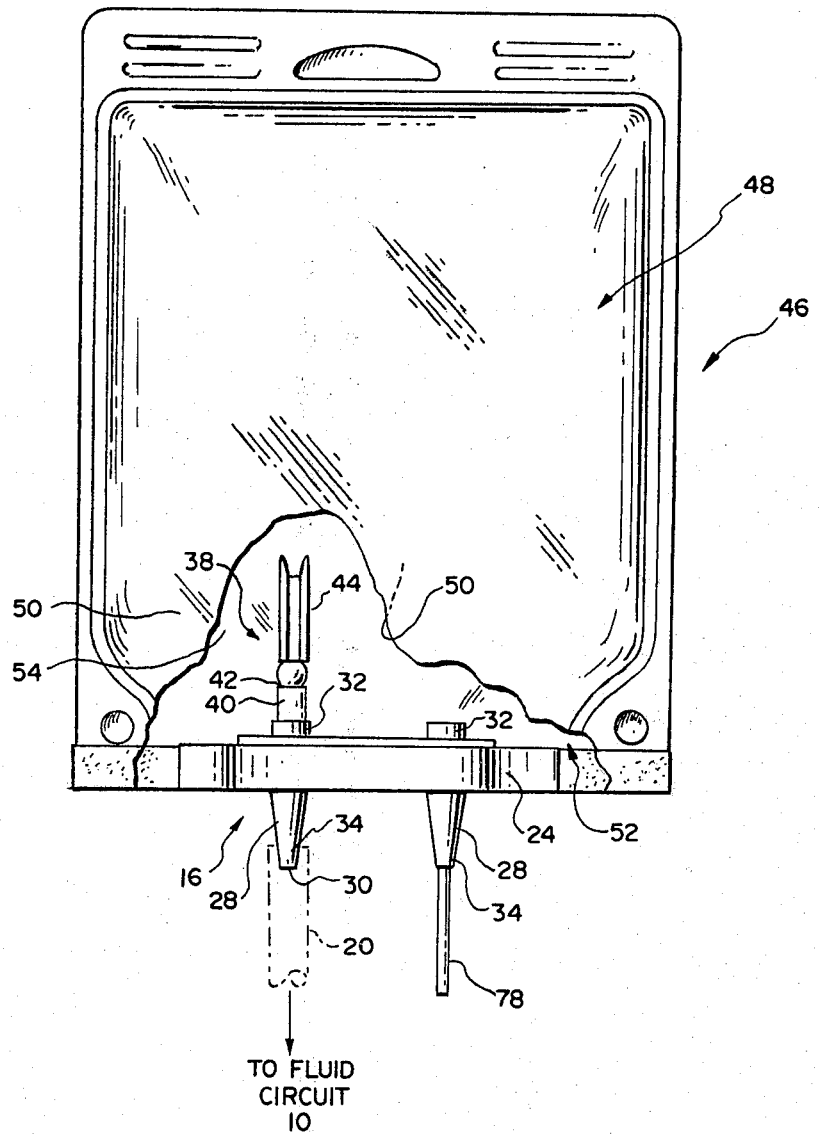
FIG. 5 is a side view of "single wall" container which includes the port block assembly generally shown in FIGS. 2 and 4 and which, like the "double wrapped" container shown in FIGS. 2 and 3, can be integrally attached to the fluid circuit shown in FIG. 1.

Reference is first made to the container embodiment shown in FIG. 5. Here, the container 46 includes wall means 48 which peripherally encloses an interior fluid chamber 50 having an access opening 52 thereto. The wall means 48 takes the form of two overlapping sheets 54 of plastic material, the peripheral edges of which are joined, such as by solvent, heat, or RF sealing, to form a flexible bag in which a fluid solution can be stored.

In this arrangement, the body portion 24 of the port block assembly 16 is fabricated of a plastic material which is similar to the sheet material and which is thus directly bondable to the peripheral edges of the access opening 52 by conventional methods, such as solvent, R.F., or heat bonding. Each insert portion 28 is fabricated of a plastic material which is directly bondable, such as by solvent bonding, to the material of which the associated fluid tubing 20 is made.

The plastic materials utilized for the container 46, the port block assembly 16, and tubing 20 can vary according to the intended use of the circuit 10. In the context of the intended use of the fluid circuit 10 in FIG. 1, medical grade polyvinyl chloride plastic formulations (hereafter identified simply as PVC) can be utilized both for the sheet material of the container 46 as well as tubes 20 of the associated circuit 10, because PVC exhibits many characteristics well suited for the storage of parenteral solutions, as well as contact with human blood. In this arrangement, both the body portion 24 and the insert portions 28 of the port block assembly 16 are likewise preferably formed of PVC, and each insert portion 28 may be attached by heat or solvent bonding within the associated port 26.

However, since it is recognized that PVC exhibits a high tendency to permit the diffusion of water vapor, which can in time lead to a change in the concentration of the stored solution, the wall means 48 of the container 46 can be constructed of overlapping sheets of a non-PVC material having a lower permeability to water vapor; for example, a polyolefin material, such as polyethylene or polypropylene, or copolymers thereof.

In this arrangement, the body portion 24 of the port block assembly 16 is preferably fabricated from the same or similar polyolefin material and can be bonded directly to the wall means 48 by conventional methods, such as solvent or heat sealing.

However, since PVC tubing still finds widespread use, the insert portions 28 are preferably fabricated from rigid, nonplasticized PVC, although acrylic or polycarbonate materials could also be used. Recognizing that PVC is dissimilar to and thus does not directly bond to propylene materials, the rigid insert portions 28 are constructed for a friction or interference fit within the ports 26 of the body portion 24, thereby eliminating the need for a thermal or chemical bond.

In the container 46 shown in FIG. 5, the tubing 20 associated with the fluid circuit 10 (which tubing is shown in phantom lines in FIG. 5) is secured to one of the insert portions 28 (shown as the left-hand side insert portion in FIG. 5). A cannula 40 and breakaway member 44 are attached to the same insert portion 28, so that fluids stored in the chamber 50 of the container 46 can be selectively dispensed, via the tubing 20, into the fluid circuit 10. As can be seen in FIG. 5, the breakaway member 44 extends partially into the fluid chamber 58 to facilitate manual manipulation to fracture the wall 42, after which the separated member 44 is freed into the chamber 50.

In this construction, the cannula 40 and breakaway member 44 are preferably made of PVC to permit a direct solvent or heat bond to the inner end 32 of the PVC insert portion 28.

In FIG. 5, another insert portion 20 (shown as the right-hand side insert portion in FIG. 5) includes a section 78 of flexible PVC tubing solvent bonded within the bore 30. The tubing section 78 terminates outwardly of the outer end 34 of the insert portion 28 and can be coupled to a source of sterilizing gas, such as ethylene oxide, to sterilize the interior fluid chamber 50. Radiation sterilization or autoclaving can also be used, depending upon the particular material from which the container 56 is fabricated.

After sterilization, the same tubing section 78 can be coupled, utilizing known sterile transfer techniques, to a source of sterile fluid to conduct the sterile fluid into the now sterilized container chamber 50. The tubing section 78 is thereafter crimped or heat sealed closed. When it is subsequently necessary to introduce the sterile fluid into the fluid circuit 10, the breakaway member 44 associated with the other insert portion 28 can be manipulated to open a fluid path leading from the chamber 50.

Figure 3:
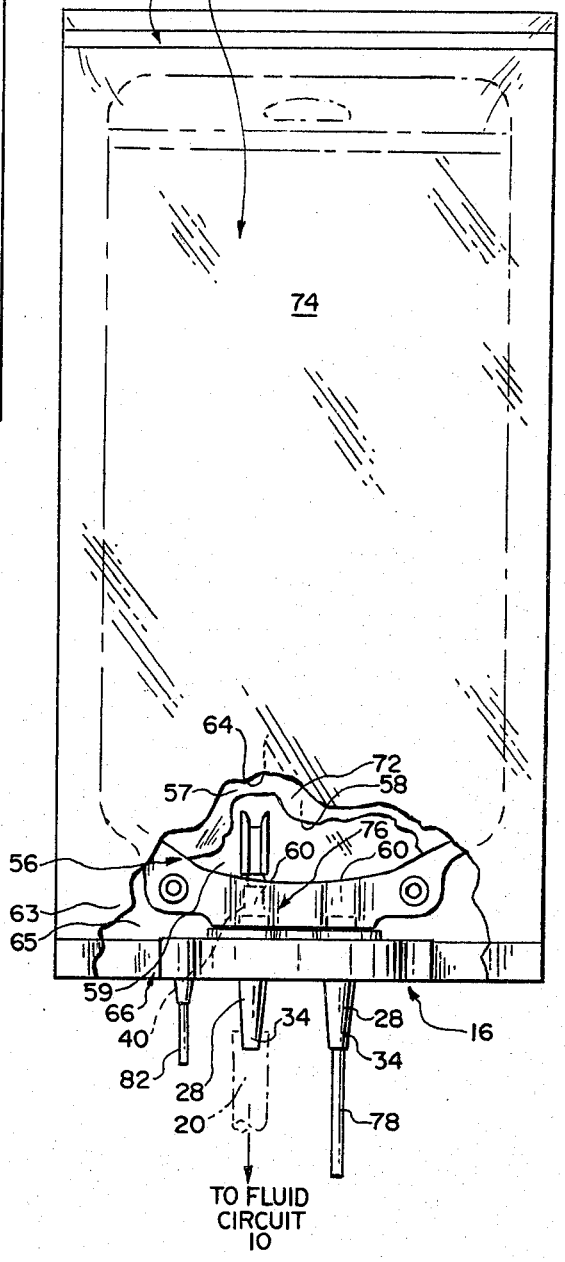
FIG. 3 is an assembled view, with parts broken away, the "double wrapped" container shown in FIG. 2.

Reference is now made to the container embodiment shown in FIGS. 1 through 3, in which container 14*b* is specifically shown. Unlike the single wall construction of container 46, the container 14*b* utilizes a double wall, or "double wrapped", construction to minimize water vapor loss from the stored solution. It should be appreciated that container 14*a* shares generally the same identical "double wrapped" construction of container 14*b*.

In this embodiment, the container 14*b* includes the first wall means 56 which peripherally encloses a fluid chamber 58 in which the solution is stored. As illustrated, the first wall means 56 takes the form of overlapping sheets 57 and 59 of material, preferably PVC, the peripheral edges of which are sealed to form a flexible bag 72 in which the fluid chamber 58 is located. Ports 60 are integrally formed in the bag 72 to provide communication with the fluid chamber 58.

The container 14*b* also includes second wall means 62 which is disposed outwardly of the first wall means 56 and which peripherally defines an interior area 64 enveloping the bag 72 and, hence, the fluid chamber 58 itself. An opening 66 is provided for access into the interior area 64. The second wall means 62 preferably takes the form of overlapping sheets 63 and 65 of material having a low vapor transmission characteristic, preferably polyethylene, to define an overwrap pouch 74 which serves as a vapor barrier surrounding the inner PVC bag 72.

In this arrangement, the body portion 24 of the port block assembly 16 is preferably fabricated of a polyethylene type material, or a chemically similar material, which is bondable directly to the periphery of the access opening 66 of the overwrap pouch 74 (see FIG. 3), such as by solvent or heat sealing methods.

On the other hand, the insert portion 28 of the port block assembly 16 is preferably formulated of rigid, nonplasticized PVC for direct solvent bonding to PVC tubing, although acrylic or polycarbonate materials could also be used. Because of the dissimilar plastics utilized, the rigid PVC insert portion 28 is sized so as to be engagable in an interference or friction fit within the port 26 of the polyethylene body portion 24.

In this embodiment, and as best seen in FIG. 2, to effect communication between the insert portion 28 and the fluid chamber 58 of the PVC bag 72, the insert portion 28 includes conduit means 76 which extends within the interior area 64 of the overwrap pouch 74 between the inner end 32 of the associated insert portion 28 and a selected port 60 of the inner bag 72.

The conduit means 76 may be variously constructed according to the particular use contemplated. In one embodiment, the conduit means 76 can take the form of the PVC cannula 40, heretofore generally described, which is solvent bonded to the end 32 of a selected insert portion 28 (the left hand insert portion 28 in FIGS. 2 and 3), as well as to an adjacent one of the bag ports 60. If a selectively operable valve mechanism is also desirable (which is usually the case), the cannula 40 can be provided with the heretofore described frangible wall 42 and breakaway member 44. As can be seen in FIG. 3, and like the FIG. 5 embodiment, the breakaway member 44 extends partially into the fluid chamber 58 to facilitate manual manipulation to fracture the wall 42, after which the separated member 44 is freed into the chamber 58.

Also like the FIG. 5 embodiment, the insert portion 28 to which the breakaway member 44 is attached is connected to the tubing 20 (shown in phantom lines in FIG. 3) associated with the fluid circuit 10.

In this regard, it should be noted that additional insert portions 28 with associated breakaway members 44 can be utilized, if desired, such as the pair associated with container 14*a* (see FIG. 1), depending upon the number of tubing connections desired. Also as shown in FIG. 1, drip chambers 86 and roller clamps 88 can be employed downstream of the containers 14*a* and *b* to further control the fluid flow from the containers 14*a* and *b* into and through the circuit 10.

In another embodiment, the conduit means 76 can take the form of the section 78 of flexible PVC tubing solvent bonded to a selected one of the bag ports, (see FIG. 2), extending therefrom through the interior area 64 of the pouch 74, and bonded within the bore 30 of another insert portion 28 (shown as the right hand insert portion in FIG. 3). As in the FIG. 5 embodiment, the tubing section 78 terminates outwardly of the outer end 34 of the insert portion 28 and can be utilized, using known sterile transfer techniques, to conduct a sterilizing gas and thence a sterile solution into the inner bag 72, after which the tubing section 78 can be crimped or heat sealed closed. Thus, just as in the FIG. 5 embodiment, when it is subsequently necessary to utilize the sterile solution in the chamber 58, the breakaway member 44 associated with another insert portion 28 can be manipulated to open a fluid path leading from the chamber 58.

Furthermore, in the embodiment shown in FIG. 2, the port block assembly 16 includes an additional port 26 and associated insert portion 28 (shown as the left hand insert portion in FIGS. 2 and 3). A section 82 of flexible tubing is bonded to the bore of this insert portion 28 and communicates only with the interior area 64 of the overwrap pouch 74. The tubing section 82 can be utilized to transfer a sterilizing gas into the interior area 74. Preferably, sterile cotton or the like is inserted into the tubing section 82 prior to sterilization to act as a sterile barrier to maintain the interior sterility of the interior area 74 surrounding the solution bag 72.

The arrangement just described permits the entire fluid circuit 10, including the integrally attached containers 14*a* and *b*, to be preassembled, presterilized, and prefilled with sterile solutions.

Figure 4:
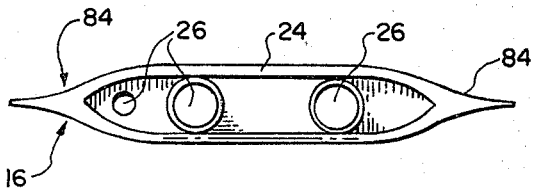
FIG. 4 is a top view of the port block assembly which embodies various of the features of the invention.

Preferably, as is best shown in FIG. 4, in each of the above described embodiments, the body portion 24 of the port block assembly 16 has a generally eliptical shape and includes gradually tapering end portions 84. This contoured shape facilitates a smooth and continuous bond between the periphery of the body portion 24 and the periphery of the access opening 52 of the container 46 (in the FIG. 5 embodiment), and between the periphery of the body portion 24 and the periphery of the access opening 66 of the overwrap pouch 74 (in the FIGS. 2 and 3 embodiment).

It should be appreciated that the port block assembly 16 heretofore described provides a secure and durable connection between a container and a fluid conduit, a connection which is capable of withstanding rough handling during shipment, storage, and use. The connection thus minimizes the chance of leaks or accidental ruptures. This durability is particularly important when sterile fluids are involved.

It should also be appreciated that the port block assembly 16 permits the construction and preattachment of prefilled, sterile solution containers to fluid circuits in a permanent manner. The assembly 16 thus significantly facilitates the creation of essentially "closed" fluid systems. It also significantly facilitates the construction of a container having a low water vapor loss characteristic and the interconnection of this container with a fluid conduit fabricated of a dissimilar material.

Finally it should be appreciated that various changes and modifications can be made without departing from the spirit of the invention or from the scope of the appended claims.

What is claimed is:

1. A port block assembly for interconnecting a fluid container fabricated of a first material with a fluid conduit fabricated of a second material which is chemically dissimilar to the first material, said assembly comprising body means having a port and being fabricated from a material which is chemically similar to the first material for bonding to the container with said port in flow communication with the interior of the container, and insert means having a bore and being fabricated from a material which is chemically similar to the second material for interference fit engagement with said body means port with a portion of said insert means exposed for bonding to the fluid conduit.

2. A port block assembly according to claim 1 wherein said insert means includes valve means communicating with said bore for normally blocking flow communication therethrough and being manually operative for selectively permitting said flow communication.

3. A port block assembly according to claim 1 and further including cannula means operative for attachment to said insert means and including frangible wall means for normally blocking flow communication therethrough and means operatively connected with said frangible wall means for fracturing said frangible wall means in response to manual manipulation to open said flow communication.

4. A port block assembly according to claim 1 wherein said body means includes a member having a generally eliptical shape with tapering opposite end positions to facilitate a smooth and continuous bond between said body means and the fluid container.

5. A container adapted for interconnection with a fluid conduit and comprising wall means fabricated from a material which is chemically dissimilar to the material of the fluid conduit, said wall means being operative for peripherally enclosing an interior fluid chamber having an access opening thereto, and a port block assembly including body means having a port and being fabricated from a material which is chemically similar to said wall means material for bonding to said wall means within said access opening with said port in flow communication with said fluid chamber, and insert means having a bore and being fabricated from a material which is chemically similar to the fluid conduit material and being operative for engagement in an interference fit within said body means port with a portion of said insert means exposed for bonding to the fluid conduit.

6. A container according to claim 5 wherein said insert means includes valve means communicating with said bore for normally blocking flow communication therethrough and being manually operative for selectively permitting said flow communication.

7. A container according to claim 5 and further including cannula means operative for attachment to said insert means and including frangible wall means normally blocking flow communication therethrough and means operatively connected with said frangible wall means for fracturing said frangible wall means in response to manual manipulation to open said flow communication.

8. A container comprising first wall means fabricated from a first material for peripherally enclosing a fluid chamber having a port, second wall means disposed outwardly of said first wall means for peripherally defining an interior area enveloping said fluid chamber and having an opening providing access into said interior area, said second wall means being fabricated from a second material having a low permeability to water vapor and being chemically dissimilar to said first material, and blockage means disposed in said access opening of said second wall means for blocking access into said interior area while opening fluid flow communication with said fluid chamber, said blockage means including a body portion having a port and fabricated from a material chemically similar to said second material for bonding to said second wall means within said second wall means access opening and a tubular insert portion having a bore defining a fluid path, said insert portion being engaged in an interference fit within said body portion port and being fabricated from a material chemically similar to said first material for bonding to said port of said first wall means to open fluid flow communication with said fluid chamber.

9. A container according to claim 1 wherein said body portion of said blockage means includes means defining a port extending therethrough and disposed in flow communication with said interior area of said second wall means when said body portion is attached within said access opening.

10. A container according to claim 8 wherein said insert portion includes valve means for normally blocking flow communication through said fluid path of said insert portion and manually operative for selectively permitting said flow communication.

11. A container according to claim 10 wherein said conduit means includes cannula means including frangible wall means for normally blocking flow communication therethrough and means operatively connected with said frangible wall means for fracturing said frangible wall means in response to manual manipulation to open said flow communication.

12. A container according to claim 11 wherein said fracturing means includes a breakaway member extending from said frangible wall means in the direction of said fluid chamber.

13. A container according to claim 12 wherein said breakaway member extends partially into said fluid chamber.

14. A container according to claim 8 wherein said body portion of said blockage means has a generally eliptical shape with tapering opposite end portions to facilitate a smooth and continuous bond between said body portion and said access opening of said second wall means.

15. A fluid conduit comprising conduit means fabricated from a first material for defining a predetermined fluid flow path, a container having an interior fluid chamber and an access opening thereto, said container being fabricated from a second material chemically dissimilar to the first material of said conduit means, and a port block assembly for said container including body means having a port and being fabricated from a material chemically similar to the second material for bonding within said access opening with said port in flow communication with said fluid chamber, and insert means having a bore and being fabricated from a material chemically similar to the first material, said insert means being operative for interference fit engagement within said body means port with a portion of said insert means bonded to said conduit means, whereby said container forms an integral part of said fluid circuit, despite the use of chemically dissimilar materials.

16. A fluid circuit comprising conduit means fabricated of a first material for defining a predetermined fluid flow path, a container comprising first wall means fabricated of said first material for peripherally enclosiong a fluid chamber and second wall means fabricated of a second material having a low permeability to water vapor and not bondable to said first material, said second wall means being disposed outwardly of said first wall means for peripherally defining an interior area enveloping said chamber and having an opening providing access into said interior area, and a port block assembly for said container including body means having a port and being fabricated from a material bondable to said second material from which said second wall means is made, said body means being operative for engagement within said opening with said port in flow communication with said interior area, and insert means having oppositely spaced end portions and a bore extending therebetween, said insert means being fabricated from a material bondable to said first material from which said conduit means and said first wall means are made and is operative for interference fit within said port of said body means with one of said end portions extending into said interior area and attached in flow communication with said fluid chamber and the opposite one of said end portions extending outwardly of said interior area and attached in flow communication with said conduit means, whereby said container forms an integral part of said fluid circuit.

17. A fluid conduit according claim 16 wherein said insert means includes valve means communicating with said bore for normally blocking flow communication therethrough and being manually operative for selectively permitting said flow communication.

18. A fluid circuit comprising conduit means fabricated of a first material for defining a predetermined fluid flow path, a container comprising first wall means fabricated of said first material for peripherally enclosing a chamber and second wall means fabricated of a second material having a low permeability to water vapor and not bondable to said first material, said second wall means being disposed outwardly of said first wall means for peripherally defining an interior area enveloping said chamber and having an opening providing access into said interior area, and a port block assembly for said container including body means having a first port and a second port and being fabricated from a material bondable to said second material from which said second wall means is made, said body means being operative for attachment within said access opening with said first and second ports in communication with said interior area, and first and second insert means each having a bore and operatively for respective engagement within said first and second ports, said first and second insert means being fabricated from a material bondable to said first material from which said conduit means and said first wall means are made and operative for interference fit within said port of said body means, one of said first and second insert means further including a portion extending within said interior area and attached in flow communication with said fluid chamber and a portion extending outwardly of said interior area and attached in flow communication with said conduit means, whereby said container forms an integral part of said fluid circuit.

19. A fluid circuit according to claim 18 wherein said one insert means includes valve means communicating with said bore for normally blocking flow communication therethrough and being manually operative for selectively permitting said flow communication.

* * * * *